US010066463B2

(12) United States Patent
Farrow

(10) Patent No.: US 10,066,463 B2
(45) Date of Patent: Sep. 4, 2018

(54) PLUNGER ASSEMBLY WITH INTERNAL DART PASSAGE

(71) Applicant: James T. Farrow, Grand Prairie, TX (US)

(72) Inventor: James T. Farrow, Grand Prairie, TX (US)

( * ) Notice: Subject to any disclaimer, the term of this patent is extended or adjusted under 35 U.S.C. 154(b) by 119 days.

(21) Appl. No.: 14/745,096

(22) Filed: Jun. 19, 2015

(65) Prior Publication Data

US 2016/0369594 A1 Dec. 22, 2016

(51) Int. Cl.
*E21B 37/04* (2006.01)

(52) U.S. Cl.
CPC ..... *E21B 37/04* (2013.01)

(58) Field of Classification Search
CPC ..... E21B 37/00; E21B 37/04; E21B 37/045; E21B 43/12; E21B 43/121; E21B 43/122
USPC ..... 166/68, 105
See application file for complete search history.

(56) References Cited

U.S. PATENT DOCUMENTS

| | | | | |
|---|---|---|---|---|
| 9,109,424 | B2 | 8/2015 | Jefferies | |
| 2003/0155117 | A1* | 8/2003 | Gray | E21B 43/121 166/107 |
| 2006/0065390 | A1 | 3/2006 | Amies et al. | |
| 2006/0249284 | A1* | 11/2006 | Victor | E21B 43/121 166/105 |
| 2009/0038796 | A1 | 2/2009 | King | |
| 2014/0246209 | A1 | 9/2014 | Themig | |
| 2014/0262204 | A1 | 9/2014 | Farris | |
| 2016/0108710 | A1* | 4/2016 | Hightower | E21B 43/121 166/372 |
| 2016/0168963 | A1* | 6/2016 | Roycroft | E21B 43/121 166/105 |

OTHER PUBLICATIONS

Office Action in related U.S. Appl. No. 14/705,941, dated May 16, 2017, 13 pages.
Office Action in related U.S. Appl. No. 14/745,142, dated May 16, 2017, 16 pages.
Office Action in related U.S. Appl. No. 14/072,651, dated May 5, 2017, 15 pages.
Office Action in related U.S. Appl. No. 14/908,112, dated Aug. 22, 2017, 13 pages.

* cited by examiner

*Primary Examiner* — D. Andrews
*Assistant Examiner* — Yanick A Akaragwe
(74) *Attorney, Agent, or Firm* — Law Office of Jeff Williams; J. Oliver Williams

(57) ABSTRACT

The present application includes and assembly having a hollowed body configured to traverse the length of a well bore and remove contaminants. The hollowed body having an upper seal body and a lower seal body. Each body including a seat for securing and sealing by a dart. The dart is configured to transition between the seats by passing through a central channel of the hollowed body. The dart includes a central passage and an unobstructed lower passage in the tip of the dart to allow for the direct passage of working fluid. The assembly further includes an expandable seal configured to expand in diameter from the increase in pressure in the well bore. The expandable seal contacts the walls of the well bore. The expandable seal cleans the walls of the well bore and prevents leakage of working fluid between the walls and the assembly.

14 Claims, 2 Drawing Sheets

PLUNGER ASSEMBLY WITH INTERNAL DART PASSAGE

BACKGROUND

1. Field of the Invention

The present application relates generally to oil field devices and, more particularly, to a plunger assembly with an internal dart channel.

2. Description of Related Art

The oil and gas industry has been drilling holes and removing natural crude oil for decades. Wells contain any number of contaminants, particulates, and water along with the gas/oil being sought. If water is not removed, pressure of the hydrostatic head of water in the surface tubing will become greater than that of the bottom hole pressure, thereby essentially sealing the formation and shutting in the well. Gas cannot on its own pressure typically flow to the surface.

Plungers are downhole tools used by operators to remove contaminants and water from productive natural gas wells. A plunger acts as an artificial lift. In operation the plunger passes down through the well until it reaches a contact point, at which point, potential energy of the plunger falling in the well acts to partially restrict the flow of working fluid through the plunger. Pressure beneath the plunger builds and raises the plunger in the well, thereby pushing out the liquids and contaminants above the plunger.

Typical plunger lift systems are inefficient partly due to the design constraints placed upon tool designers. A common limitation of existing plungers is the way the working fluid is routed through the plunger. Typically, a dart is located within a plunger body and has one or more side ports that allow working fluid to enter the dart horizontally. The tip of the dart is made to contact a stop at the bottom of the well and has no port or channel. This limitation can decrease the flow of working fluid by necessitating the directional change of fluid flow. Additionally, side ports may clog more easily from particulates and contaminants in the working fluid.

An additional disadvantage is the effect of a "drift diameter" restraining the size of the plunger in relation to the well bore. The drift diameter is the minimum inside diameter of the tube in order to pass a ridged tool of some set length through it. Tools are designed to have a maximum diameter no greater than the drift diameter of the tubing. This results in the tools having a gap between them and the ID of the tubing. The large annulus or gap between the tool and the tubing that the tools passes through are one reason why tools tend to be inefficient because plunger lift tools work on a pressure gradient between fluid beneath the tool and fluid above the tool. Leaks between the tool and tubing impact the pressure gradient.

Another disadvantage of conventional plunger lift systems are the particulates (i.e. sand) in the working fluid. The working fluid passes within the gap between the plunger lift system and the casing at increased speeds resulting in tools abrading quickly. Additionally, the leak leads to turbulence created around the down hole edge of the tool when it expands after passing through the leak. A new plunger lift assembly tool is required to minimize abrading, that corrects for the constraints associated with the drift diameter, and an improved dart to yield a better flow of working fluid.

Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
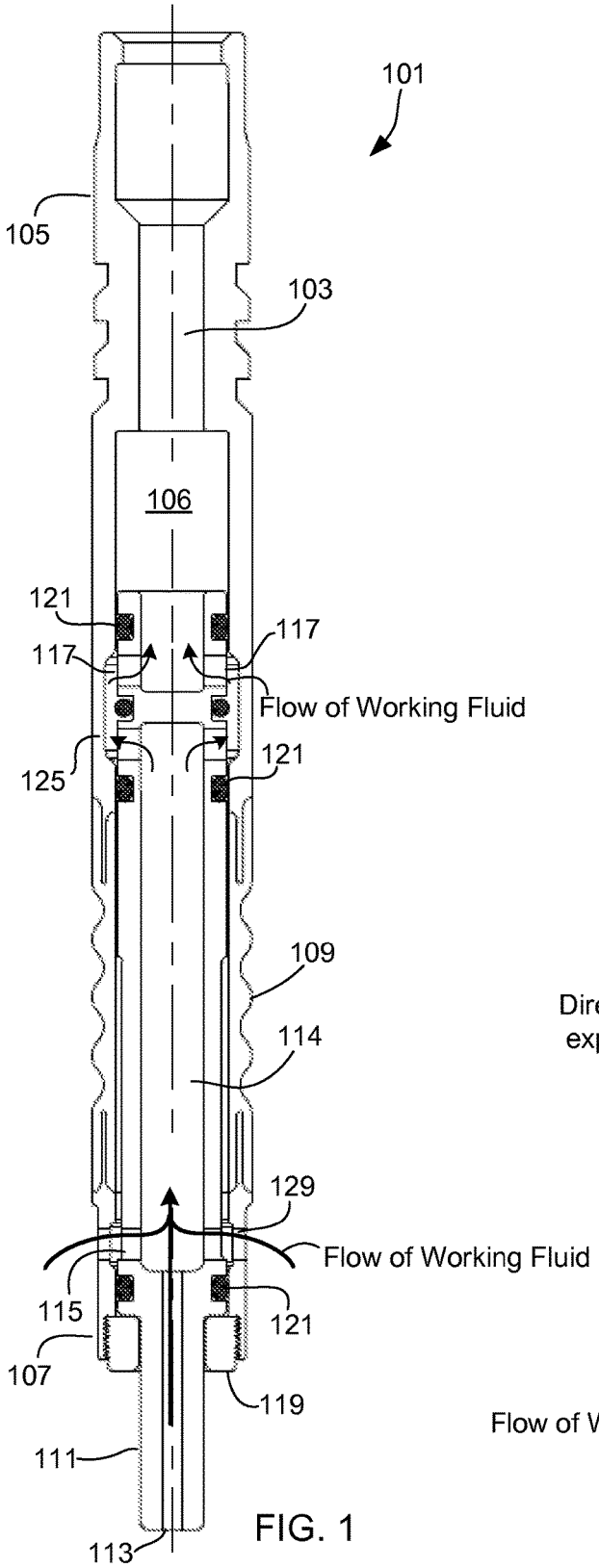
FIG. 1 is a side section view of a plunger assembly having a dart in an extended position according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional plunger lift systems. The assembly 101 of the present application is configured to translate within the tubing of a well bore between a raised top position and a lowered bottom position. The raised top position is located at the surface of the well bore while the lowered bottom position is located at the base of the well bore deep within the ground. Specifically, the assembly is configured to provide a dart with a central passage for the routing of the working fluid through the plunger assembly. The passage is fed through a lower passage at the tip of the dart. The lower passage remains open/unobstructed when the dart is seated. Bypass passages are also included at the upper portion of the dart to selectively close off the flow of working fluid through the dart.

Also included is an expandable seal configured to selectively expand as a result of pressure built up below the assembly. The pressure within a central passage of the dart builds as the bypass passages are closed. The pressure expands the expandable seal so as to contact the walls of the tubing in the well bore. Fluid pressure raises continues to build beneath the assembly until the assembly begins to translate within the well bore. The expandable seal rubs against the walls as the assembly is raised to the surface. As the pressure gradient in the well decreases and the assembly is permitted to fall, the expandable seal retracts in size smaller than the drift diameter of the well bore. The expandable seal creates a seal against the walls of the well bore to eliminate leakage past the assembly. The expandable seal also acts to stabilize the assembly in the well bore. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The plunger assembly of the present application is illustrated in the associated drawings. The assembly includes a hollowed body including an upper seal body, a lower seal body, and an expandable seal coupled together. A central channel passes through each body and the expandable seal to permit the translation of a dart within the hollowed body. The dart regulates the flow of working fluid through the hollowed body by engaging an upper seat and a lower seat located in the upper seal body and the lower seat body, respectively.

Figure 2:
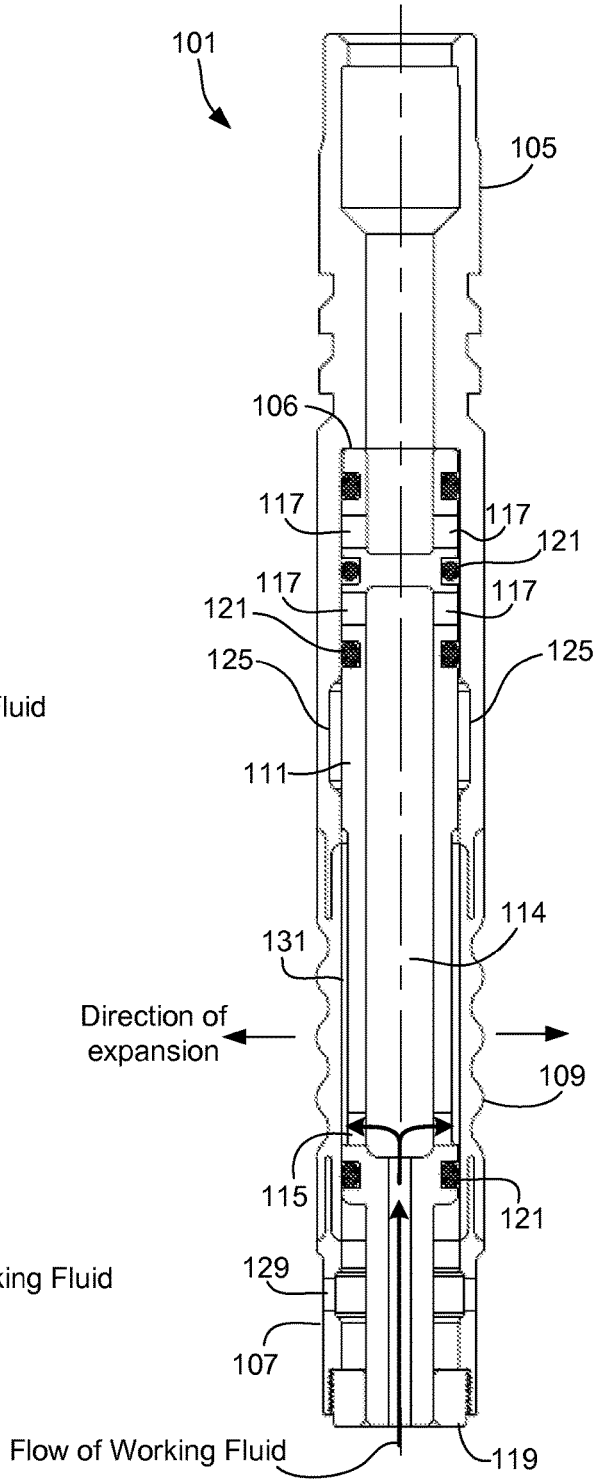
FIG. 2 is a side section view of the plunger assembly of FIG. 1 having the dart in a seated position.

Referring now to the drawings wherein like reference characters identify corresponding or similar elements in form and function throughout the several views. FIGS. 1 and 2 illustrate plunger assembly 101. Assembly 101 includes a hollowed body having a central channel 103 that passes through an upper seal body 105, a lower seal body 107, and an expandable seal 109. Bodies 105 and 107 with seal 109 collectively form the hollowed body. Assembly 101 also includes a dart configured to translate within the central channel of both bodies 105 and 107.

Dart 111 is configured to selectively translate within the central channel 103 between an upper seat 106 and a lower seat 108, respectively located in upper seal body 105 and lower seal body 107. Dart 111 includes an upper portion 110 and a lower portion 112 (see FIG. 3). Working fluid is configured to selectively pass through the central channel of lower seal body 107, through a central passage 114 of dart 111, into the central channel of upper seal body 105. By regulating the flow of working fluid through the central channels, assembly 101 is permitted to raise and lower in the well bore.

Assembly 101 is illustrated in two configurations, a falling configuration (FIG. 1) and a rising configuration (FIG. 2). The difference between the configurations is the location of dart 111. In FIG. 1 fluid is permitted to pass completely through dart 111 and exit through upper seal body 105. In fact, assembly 101 is configured that working fluid passes through passages within dart 111 as opposed to directly through central channel 103. Working fluid enters dart 111 at lower portion 112 through a lower passage 113 and a side passage 115. Working fluid is configured to exit dart 111 through a bypass passage 117 in upper portion 110.

As dart 111 is located in upper seat 106 (see FIG. 2), bypass passages 117 are closed off preventing the passage of working fluid. At such time a pressure gradient on either end of assembly 101 develops. The pressure gradient causes the rise of assembly 101 within the tubing of the well bore. Assembly 101 continues to rise until it strikes a striker rod which dislodges dart 111 and seats it in lower seat 108. As dart is located in seat 108, working fluid is permitted to enter passages 113/115 and exit bypass passages 117. At such time the pressure gradient on either ends of assembly 101 is minimalized such that assembly 101 falls through the tubing of the well bore. Falling occurs until assembly 101 strikes a stop or other equipment in the tubing of the well bore which contacts dart 111 and presses it upward into upper seat 106. A pressure gradient then develops to eventually raise assembly 101 back to the surface of the well bore. This cycle repeats until an operator interrupts the process.

Assembly 101 further includes a retaining nut 119. Retaining nut 119 is configured to hold dart 111 within bodies 105 and 107 and prevent the undesired removal of dart 111 during operation of assembly 101 within the tubing of the well bore. Nut 119 is held by interference fit with seal body 107. Lower portion 112 of dart 111 contacts nut 119 when seated in lower seat 108. Dart 111 may be removed from bodies 105/107 by disengaging nut 119 from lower seal body 107.

It is understood that dart 111 is permitted to freely travel within central channel 103. Dart 111 includes one or more seals 121 in lower portion 112 and upper portion 110 to restrict the passage of working fluid and to provide some resistance to motion for dart 111. It is further understood that at least one of upper seal body 105 and lower seal body 107 may be configured to mechanically hold and restrict translation of dart 111, so as to prevent the undesired movement of dart 111 during translation of assembly 101 within the well bore. Furthermore, although contact between dart 111 and a stop at the bottom of the well bore has been described as the method of seating dart 111 in seat 106, it is understood that assembly 101 may use the pressure gradient within the well bore to fully seat dart 111 in seat 106.

Figure 3:
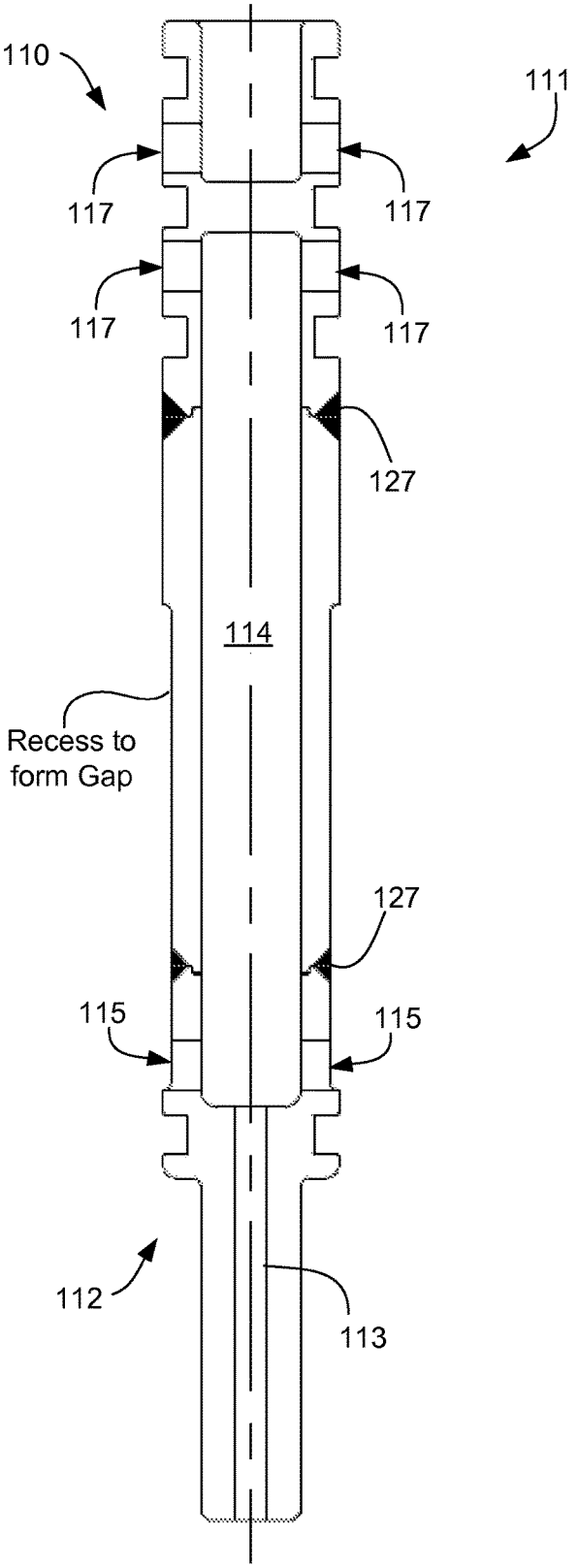
FIG. 3 is a side section view of the dart of FIG. 1.
Figure 4:
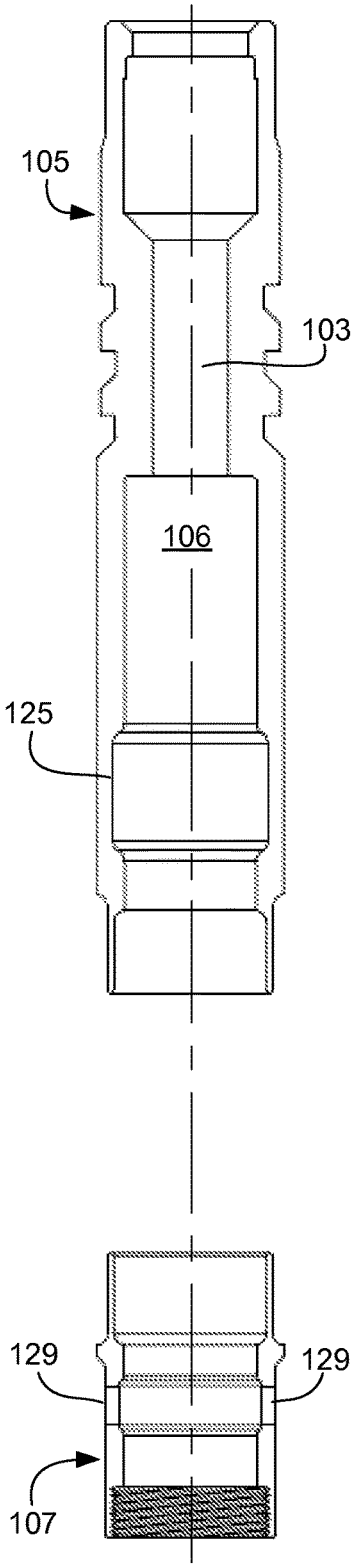
FIG. 4 is a side section view of a hollowed body of the plunger assembly of FIG. 1.

Referring now also to FIGS. 3 and 4 in the drawings, side section views of dart 111 and the hollowed body, respectively, are illustrated. Seals 121 have been removed from FIG. 3 to allow for a more clear view of just dart 111. As noted previously, dart 111 includes lower passage 113 that extends the length of lower portion 112 of dart 111. Lower passage 113 deposits working fluid directly into central passage 114. Lower passage 113 is unobstructed as dart 111 is seated in lower seat 108 and upper seat 106. An advantage of lower passage 113 is that as assembly 101 falls within the well bore, working fluid passes straight through without the need to change direction as with side passages 115. Side passages 115 are also shown. Side passages 115 are within lower portion 112 and deposit working fluid directly into central passage 114. Central passage 114 is configured to communicate direct the working fluid to bypass passage 117*a-b*. A stop 123 is located within central passage 114 to block the direct flow of working fluid out upper portion 110. Working fluid is configured to exit central passage 114 through bypass passage 117*a* and re-enter central passage 114 through bypass passage 117*b*. Working fluid then exits upper portion 110 centrally within upper seal body 105. Upper seal body 105 includes a groove 125 (see FIGS. 1 and 2) formed in the inner surface to permit a path for the travel of working fluid through bypass passage 117. Seals 121 press against the inner surfaces of upper seal body 105 and lower seal body 107 and dart 111 to provide a seal.

It is noted that dart 111 may be made from a single member or be a compilation of multiple members that are coupled together. For example, dart 111 may be welded together from three separate members as seen by weld marks 127. It is understood that although passages 113/115/117/114 have been described in singular terms, assembly 101 is not so limited. One or more passages 113/115/117/114 may be used in different embodiments.

Referring now back to FIGS. 1 and 2 in the drawings. Assembly 101 further includes expandable seal 109 coupled between upper seal body 105 and lower seal body 107. Seal 109 is configured to use mechanical and/or chemical methods to create a releasable bond with upper seal body 105 and lower seal body 107. It is important to note that seats 106 and 108 are located within bodies 105, 107 at opposing ends of seal 109. Therefore, dart 111 is configured to pass within seal 109 to engage seats 106 and 108. Dart 111 is configured to extend the full length of seal 109 when seated in both upper seat 106 and lower seat 108.

Lower seal body 107 includes a side port 129 configured to communicate with side passages 115. When dart 111 is seated in lower seat 108, working fluid passes through side port 129 and through its corresponding side passage 115 of dart 111. A gap 131 is formed between port 129 and passage 115. This gap 131 is a result of dart 111 having a recessed outer diameter above seals 121 in lower portion 112 and along a portion of dart 111 below upper portion 110. Gap 131 extends from passage 115 along the length of dart 111 adjacent seal 109. When dart is seated in seat 106, the recessed diameter ends below groove 125.

A key feature of assembly 101 is the operation of lower passage 113, remaining unobstructed. Another key feature of assembly 101 is the use of seal 109. Seal 109 is configured to selectively expand in diameter upon the increase of pressure below assembly 101. Working fluid continues to pass through lower passage 113 into central passage 114. Since bypass passages 117 are closed, working fluid now exits passages 115 into gap 131 formed between seal 109 and dart 111 in the recessed area. Increased pressure within passage 114 expands seal 109 outward as directed in FIG. 2. Seal 109 contacts the walls of well bore and creates a seal against the wall. The pressure gradient increases until it becomes large enough to begin lifting assembly 101 within the tubing of the well bore. While raising to the surface, seal 109 rubs along the walls, acting to dislodge scale build up and clean the walls. When assembly 101 reaches the surface, the pressure is relieved and seal 109 reduces in diameter to a measurement within the drift diameter.

Working fluid within the tubing of the well bore contains a number of contaminants, debris, particulates, oils, and so forth that can be abrasive and damaging to objects and tools. There are many advantages of having seal 109 contact the walls of the tubing in the well bore 109, some of them are as follows: (1) Seal 109 rubs and scrapes the walls clean when rising. This serves to prolong the life of the tubing/casing and maintain the integrity of the well bore. (2) Scale buildup decreases the relative internal diameter of the tubing leading to potential clogging of tools. Seal 109 therefore maintains the drift diameter. (3) Seal 109 creates a seal against the walls that prevents the passage of working fluid (leakage). Therefore, creating the seal reduces abrading. (4) Contact between expandable seal 109 and the walls increases stabilization of assembly 101.

It is understood that there is a balance between the hardness and flexibility of seal 109. Seal 109 is hard enough to provide sufficient abrasion to the walls of well bore 90 but yet is flexible enough to expand at a pressure level lower than is necessary to lift assembly 101. Seal 109 is configured to have sufficient flexibility to accommodate variations in well bore diameter.

Additionally, although seal 109 has been described, it is understood that seal 109 may be replaced with a hardened and rigid member such that the body surrounding dart 111 is configured to not expand as a result of the pressure gradients. Because contact with a stop or other equipment in the lower end of the well is used to unseat dart 111 from seat 108, use of seal 109 may provide an absorption effect and minimize such forces. This effect can be desirable and may lengthen the life span of assembly 101 by minimizing such forces. However, such absorption of forces is to be limited to still permit the function of dart 111. It is contemplated that other embodiments of assembly 101 may use a fully rigid outer body surrounding dart 111.

The current application has many advantages over the prior art including at least the following: (1) unobstructed lower passage in the tip of the dart to permit the direct passage of working fluid into a central passage; (2) passage of the working fluid through the dart; (3) working fluid exiting the dart through the central channel of the upper body; (4) recessed outer diameter of the dart to provide a gap between the dart and the lower body and seal; (5) an expandable seal to press against the walls of the well bore and create a seal; (6) the expandable seal prevents leakage of working fluid between the assembly and the walls of the well bore; (7) the dart is interchangeable without breaking down the outer hollowed body; and (8) side passages selectively permit the introduction of working fluid to the central passage and the removal of working fluid from the central passage.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A plunger assembly for removing contaminants within a well bore, comprising:

an upper seal body having an upper seat;

a lower seal body having a lower seat and a side port;

a dart having an upper portion and a lower portion being coupled through a central passage, the lower portion including a lower passage at a tip of the dart and a side passage adjacent the lower passage, the upper portion including a bypass passage, wherein working fluid is configured to continuously enter through the lower passage and selectively enter through the side passage so as to pass through the central passage and selectively exit through the bypass passage, the lower passage is configured to remain unobstructed as the dart is seated in both the upper seat and the lower seat, the working fluid selectively passing through the central passage of the dart when seated in both the upper seat and the lower seat such that working fluid enters and exits the dart outside of the lower seal body, the dart remaining within both the lower seal body and the upper seal body when seated in both the upper seat and the lower seat; and an expandable seal coupled between the upper seal body and the lower seal body outside of the dart; the dart further including a recessed outer diameter both at and above the side passage configured to form a gap between the expandable seal and the dart, wherein working fluid enters through the lower passage and the side passage when the dart is seated in the lower seat;

wherein the working fluid enters only through the lower passage when the dart is seated in the upper seat, the working fluid being routed outward through the side passage into the gap to selectively expand the seal to contact tubing in the well bore when subjected to a pressure gradient;

wherein the selective regulation of working fluid through the dart affects the movement of the plunger assembly within the well bore.

2. The assembly of claim 1, wherein the dart is configured to be removed from the upper seal body and the lower seal body.

3. The assembly of claim 1, further comprising:

a retaining nut in communication with the lower seal body, the retaining nut configured to prevent the undesired removal of the dart during operation within the well bore.

4. The assembly of claim 1, wherein at least one of the upper seal body and the lower seal body is configured to mechanically hold the dart in a seated position to prevent undesired movement during translation within the well bore.

5. The assembly of claim 1, wherein pressure gradient within the well bore seats the dart in the upper seat.

6. The assembly of claim 1, wherein the side passage is aligned with the side port when the dart is seated in the lower seat.

7. The assembly of claim 1, wherein the dart is configured to selectively permit the entering and exiting of working fluid through the side passage depending on the position of the dart relative to the upper seat and the lower seat.

8. The assembly of claim 1, wherein the diameter of the expandable seal expands and contacts the walls of the well bore when the dart is seated in the upper seal body.

9. The assembly of claim 1, wherein the contact between the expandable seal and the walls occur as the assembly rises within the well bore.

10. The assembly of claim 9, wherein the contact during rising removes deposits and scales from the walls.

11. The assembly of claim 9, wherein contact between the expandable seal and the walls of the well bore are configured to increase stabilization of the assembly within the well bore.

12. The assembly of claim 1, wherein the expansion of the expandable seal minimizes leakage of working fluid between the assembly and the well bore.

13. The assembly of claim 1, wherein the dart extends the full length of the seal.

14. The assembly of claim 1, wherein the gap separates the expandable seal and the dart.

* * * * *